US011730277B2

(12) United States Patent
Harris et al.

(10) Patent No.: US 11,730,277 B2
(45) **Date of Patent: *Aug. 22, 2023**

(54) COMPOSITE MATTRESSES WITH AIR CHAMBERS

(71) Applicant: Purple Innovation, LLC, Lehi, UT (US)

(72) Inventors: Brock Keith Harris, Draper, UT (US); James T. Grutta, Draper, UT (US); Brett Pearson, Taylorsville, UT (US); Michael Allen Pierce, American Fork, UT (US)

(73) Assignee: Purple Innovation, LLC, Lehi, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/568,478

(22) Filed: Jan. 4, 2022

(65) Prior Publication Data

US 2022/0125216 A1 Apr. 28, 2022

Related U.S. Application Data

(63) Continuation of application No. 17/176,498, filed on Feb. 16, 2021, now Pat. No. 11,213,139.
(Continued)

(51) Int. Cl.
*A47C 27/08* (2006.01)
*A47C 27/10* (2006.01)
(Continued)

(52) U.S. Cl.
CPC ..... *A47C 27/083* (2013.01); *A47C 27/06* (2013.01); *A47C 27/10* (2013.01); *A47C 27/18* (2013.01); *A47C 31/105* (2013.01)

(58) Field of Classification Search
CPC ..... A47C 27/00; A47C 27/001; A47C 27/06; A47C 27/08; A47C 27/081; A47C 27/083;
(Continued)

(56) References Cited

U.S. PATENT DOCUMENTS 2,651,788 A 9/1953 Forwood
2,814,053 A 11/1957 Sevcik
(Continued)

FOREIGN PATENT DOCUMENTS

WO WO-2021163682 A1 * 8/2021 ..... A47C 27/001
WO WO-2021207259 A1 * 10/2021 ..... A47C 21/044

OTHER PUBLICATIONS

USPTO acting as International Searching Authority, "International Search Report and Written Opinion," International Application No. PCT/US2021/018173, dated Apr. 29, 2021.

*Primary Examiner* — Robert G Santos
(74) *Attorney, Agent, or Firm* — Dentons Durham Jones Pinegar

(57) ABSTRACT

A composite mattress includes a pressurizable layer and a top layer. A coiled spring layer may also be included in the composite mattress. The composite mattress may also include a base layer and/or an intermediate layer. A foundation, or rail, may laterally surround the pressurizable layer and the top layer. The composite mattress may include a cover, including a base panel, a periphery, and a top panel. The cover may encase the other components of the composite mattress. The composite mattress may include a separable top and bottom; these elements may be modular, enabling individuals or couples to customize a mattress by selecting one or more tops from a plurality of available tops for use with one or more bases from a plurality of available bases.

20 Claims, 5 Drawing Sheets

Related U.S. Application Data

(60) Provisional application No. 62/976,173, filed on Feb. 13, 2020.

(51) Int. Cl.
*A47C 27/06* (2006.01)
*A47C 27/18* (2006.01)
*A47C 31/10* (2006.01)

(58) Field of Classification Search
CPC ..... A47C 27/087; A47C 27/10; A47C 27/14; A47C 27/148; A47C 27/15; A47C 27/18; A47C 31/105
USPC ... 5/711, 690, 710, 712, 713, 716, 722, 727, 5/728, 737, 738, 740
See application file for complete search history.

(56) References Cited

U.S. PATENT DOCUMENTS

| | | | | |
|---|---|---|---|---|
| 3,950,800 | A | 4/1976 | Garshfield | |
| 4,224,706 | A | 9/1980 | Young | |
| 4,306,322 | A | 12/1981 | Young et al. | |
| 4,449,261 | A | 5/1984 | Magnusson | |
| 4,803,744 | A | 2/1989 | Peck et al. | |
| 5,065,485 | A | 11/1991 | Zocco | |
| 5,259,079 | A | 11/1993 | Visser et al. | |
| 6,101,653 | A | 8/2000 | England | |
| 6,197,099 | B1 | 3/2001 | Pearce | |
| 6,317,912 | B1 | 11/2001 | Graebe et al. | |
| 6,413,458 | B1 | 7/2002 | Pearce | |
| 6,797,765 | B2 | 9/2004 | Pearce | |
| 7,060,213 | B2 | 6/2006 | Pearce | |
| 7,076,822 | B2 | 7/2006 | Pearce | |
| 7,964,664 | B2 | 6/2011 | Pearce | |
| 8,919,750 | B2 | 12/2014 | Pearce et al. | |
| 10,881,217 | B2 | 1/2021 | Moon et al. | |
| 11,213,139 | B2 | 1/2022 | Harris et al. | |
| 11,311,111 | B2 * | 4/2022 | Grutta | A47C 27/10 |
| 11,317,733 | B2 * | 5/2022 | Pearce | A47C 27/06 |
| 2002/0124320 | A1 | 9/2002 | Washburn et al. | |
| 2004/0226098 | A1 | 11/2004 | Pearce | |
| 2006/0253988 | A1 | 11/2006 | Pearce | |
| 2007/0277325 | A1 | 12/2007 | Bertram et al. | |
| 2009/0126107 | A1 | 5/2009 | Kuo | |
| 2010/0146709 | A1 | 6/2010 | Lafleche et al. | |
| 2011/0162140 | A1 | 7/2011 | Paris | |
| 2011/0296623 | A1 | 12/2011 | Lafleche et al. | |
| 2013/0043628 | A1 | 2/2013 | Pearce et al. | |
| 2016/0242562 | A1 | 8/2016 | Karschnik et al. | |
| 2017/0086597 | A1 | 3/2017 | Dahlin et al. | |
| 2017/0251825 | A1 | 9/2017 | Pearce | |
| 2019/0029438 | A1 | 1/2019 | Moon et al. | |
| 2019/0150632 | A1 | 5/2019 | Pearce et al. | |
| 2021/0251393 | A1 * | 8/2021 | Harris | A47C 27/083 |
| 2021/0307527 | A1 * | 10/2021 | Grutta | A47C 27/056 |
| 2022/0125216 | A1 * | 4/2022 | Harris | A47C 27/15 |
| 2022/0248867 | A1 * | 8/2022 | Grutta | A47C 27/18 |
| 2022/0257025 | A1 * | 8/2022 | Pearce | A47C 27/20 |
| 2023/0067095 | A1 * | 3/2023 | Teller | A47C 27/144 |

* cited by examiner

COMPOSITE MATTRESSES WITH AIR CHAMBERS

CROSS-REFERENCE TO RELATED APPLICATIONS

This application is a continuation of U.S. patent application Ser. No. 17/176,498, filed on Feb. 16, 2021 and titled COMPOSITE MATTRESSES WITH AIR CHAMBERS ("the '498 application"), which issued as U.S. Pat. No. 11,213,139 on Jan. 4, 2022. The '498 application includes a claim for priority under 35 U.S.C. § 119(e) to the Feb. 13, 2020 filing date of U.S. Patent Application No. 62/976,173, titled COMPOSITE MATTRESSES WITH AIR CHAMBERS ("the '173 Provisional Application"). The entire disclosures of the '498 Application and the '173 Provisional Application are hereby incorporated herein.

TECHNICAL FIELD

This disclosure relates generally to mattresses with air chambers and, more specifically, to composite mattresses that include air chambers. Such composite mattresses may comprise modular mattresses, in which a mattress base that includes air chambers may be used with any of a variety of modular tops. Cushioning methods and methods for personalizing a mattress are also disclosed.

RELATED ART

A variety of airbed mattresses are currently available. An airbed mattress typically includes a plurality of air chambers supported, laterally surrounded by, and covered by layers of foam. Air pressure within the air chambers may be adjusted to provide the air mattress or a portion (e.g., a side, a head section, a lumbar section, a foot section, etc.) thereof with a desired level of firmness or softness. While existing airbed mattresses enable an individual to choose the firmness or softness of the mattress or various portions thereof, the cushioning options they provide to consumers are limited.

SUMMARY

Various embodiments of mattresses are disclosed that combine the air chambers of a conventional airbed mattress with premium cushioning elements.

A mattress according to this disclosure, which may comprise an airbed mattress, may also be referred to herein as a "composite mattress." Such a mattress may include a pressurizable layer with at least one air chamber, a top layer that comprises a cushioning element over the pressurizable layer, and a cover.

In a specific embodiment, from its base to its upper, supporting surface, a composite mattress according to this disclosure may include a base panel of a cover, or "base cover," a base layer, the pressurizable layer, an intermediate layer, the top layer, and a top panel of the cover, or "top cover." A foundation, or rail, may laterally surround the pressurizable layer, at least a portion of the intermediate layer, and the top layer. A periphery of the cover, which may be referred to herein as a "cover periphery," may laterally surround the foundation, and may extend between the base cover and the top cover. In some embodiments, such a mattress may also include a coiled spring layer, which may comprise an array of mattress springs. Such a coiled spring layer may be located beneath the air chamber(s) or between the top layer and the air chamber(s).

The base layer of such a mattress may comprise a relatively stiff, or firm, element or it may comprise a compressible, resilient cushioning element with a desired rate of return. The base layer may be substantially contiguous, or uninterrupted across its entirety. Alternatively, the base layer may comprise a plurality of resiliently compressible walls that defines a plurality of resiliently buckling columns and a void within each column.

The pressurizable layer may comprise a single air chamber or a plurality of air chambers. In some embodiments, a single column of air chambers that extend substantially from one side of the mattress to the other (i.e., horizontally) may be arranged from substantially one end of the mattress (e.g., a head end of the mattress, etc.) to the other end of the mattress (e.g., a foot end of the mattress, etc.) (i.e., vertically). In other embodiments, a single row of air chambers that extend substantially from one end of the mattress (e.g., the head end of the mattress, etc.) to the other end of the mattress (e.g. the foot end of the mattress, etc.) (i.e., vertically) may be arranged substantially from one side of the mattress to the other side of the mattress (i.e., horizontally). In still other embodiments, an array of air chambers may be organized substantially across the mattress. In these contexts, the term "substantially" has been used to indicate the possible presence of lateral support members, or foundations, at one or more locations around the outer periphery of the composite mattress.

In embodiments where the mattress includes a plurality of air chambers, each air chamber of the plurality may be pressurized (e.g., inflated, deflated, etc.) independently of every other air chamber of the plurality.

The intermediate layer may comprise a cushioning element. The cushioning element may comprise any suitable material. As an example, the intermediate layer may include a material that is compressible and has a desired resilience and rate of return. The intermediate layer may be substantially contiguous, or uninterrupted across its entirety. The base layer may comprise a plurality of resiliently compressible walls that defines a plurality of resiliently buckling columns and a void within each column.

The cushioning element of the top layer may comprise a premium cushioning element, such as a cushioning element formed from an elastomeric gel, a cushioning material that flows non-resiliently under pressure (i.e., a cushioning material that has little or no return), or any other suitable cushioning material. In some embodiments, the base layer may comprise a plurality of resiliently compressible walls that defines a plurality of resiliently buckling columns and a void within each column. In some embodiments, the top layer may be substantially contiguous, or uninterrupted across its entirety.

The top layer may also comprise one or more cushioning elements. In embodiments where the top layer includes a plurality of cushioning elements, the cushioning elements may be superimposed relative to one another. In embodiments where two or more of the cushioning elements include a plurality of resiliently compressible walls that define an array of resiliently buckling columns and a void within each column, the resiliently compressible walls and the resiliently buckling columns may be offset.

The top layer may be laterally surrounded and supported by an upper foundation, or an upper rail. The upper foundation may comprise any suitable material. As an example, the upper foundation may comprise a structured foam.

The foundation, which may also be referred to as a "lower foundation," may include one or more peripheral foundation members that define a foundation receptacle. In some embodiments, the foundation may include four members that at least partially define a periphery of the mattress (e.g., a head member, a foot member, and two side members, etc.). The foundation receptacle receives the base layer, the pressurizable layer, and the intermediate layer.

The cover periphery laterally surrounds the foundation, the base layer, the pressurizable layer, and the intermediate layer, as well as the top layer. In some embodiments, at least a portion of the cover periphery may extend (e.g., upwardly, etc.) from peripheral edges of the base panel of the cover, which may also be referred to as the "cover base." In some embodiments, a base portion of the cover periphery may be continuous with peripheral edges of a base panel of the cover, with base portion of the cover periphery and the base panel defining a base portion of the cover. Together, the base and the base portion of the cover periphery may also define a receptacle of the base portion of the cover, which may receive the foundation, any elements carried by the foundation receptacle, and, optionally, at least part of the intermediate layer of the composite mattress.

A coupler or a portion of a coupler may enable the top portion of the cover to be secured to the base portion of the cover. Such a coupler may be located at or adjacent to a top edge of the base portion of the cover. More specifically, one coupling element of the coupler may be located at or adjacent to a top edge of the base portion of the cover, while another complementary coupling element of the coupler may be associated with the top portion of the cover.

In some embodiments, the cover periphery may also include a top portion, which may extend from and even be continuous with peripheral edges of a top panel of the cover. In such embodiments, the top portion of the cover periphery and the top panel may define a top portion of the cover. In such embodiments, the base coupler may be located at or adjacent to a top edge of the base portion of the cover, while the top coupler may be located at or adjacent to a bottom edge of the top portion of the cover.

The base portion of the cover may carry the foundation, the base layer, the pressurizable layer, the intermediate layer, and the base coupler. Together, these elements may define a base of the mattress, or a "mattress base." The top portion of the cover may carry the top layer and other optional elements (e.g., an upper foundation, an upper frame, one or more additional layers, etc.) that may define a top of the mattress, or a "mattress top."

The mattress base of this disclosure may be used with and coupled to any of a variety of mattress tops. Likewise, any of a variety of mattress bases of this disclosure may be used with and coupled to a particular mattress top. Thus, mattress bases and mattress tops according to this disclosure may be modular, enabling an individual (or a couple) to select a mattress base with particular characteristics (e.g., a configuration of air chambers; an arrangement of air chambers, coils, and/or other layers; etc.) and a mattress top with particular characteristics (e.g., thickness, cushioning properties, arrangement of top cushioning layers, etc.). In some embodiments, a single mattress base may have a configuration that enables it to receive two or more mattress tops. In other embodiments, two or more mattress bases may collectively receive a single mattress top.

According to another aspect of this disclosure, the modularity of various embodiments of a mattress according to this disclosure may enable various methods for personalizing a mattress. In such a method, an individual (or a couple) may select a mattress base or a plurality of mattress bases. The mattress base may comprise a modular mattress base with one or more desired features and/or characteristics. In some embodiments, the mattress base may include an air chamber or a plurality of air chambers in a desired arrangement. Optionally, the mattress base may include a layer of coil springs, or a "coiled spring layer," and, in some embodiments, other layers. A coiled spring layer may be located under and/or over the pressurizable layer; in some embodiments, the coiled spring layer(s) may be located adjacent to the pressurizable layer, with only a compliant intervening layer located between each coiled spring layer and the pressurizable layer.

The individual (or the couple) may also select a mattress top or a plurality of mattress tops that is/are compatible with a selected mattress base(s). The mattress top may include a top layer that includes a plurality of compressible walls defining an array of buckling columns and a void within each column.

Once the mattress base(s) and the mattress top(s) have been selected, the mattress top(s) may be positioned over the mattress base(s) and coupled to the mattress base(s).

This disclosure also includes cushioning methods. A cushioning method according to this disclosure may include positioning at least part of an individual's body on a cushioning layer that comprises a plurality of compressible walls defining an array of buckling columns to support at least that part of the individual's body. In addition, one or more air chambers beneath the cushioning layer may be individually pressurized (e.g., inflated, deflated, etc.) to define a contour of the cushioning layer. Individual pressurization of one or more of the air chambers may occur before positioning at least part of the individual's body on the cushioning layer. Alternatively, one or more of the air chambers may be individually pressurized after the cushioning layer supports at least part of the individual. Pressurization of one or more of the air chambers may be adjusted while the cushioning layer and the air chambers support at least part of the individual's body. In some embodiments, pressurization adjustments may occur automatically, in accordance with a program (e.g., based on one or more of a pressure profile of the individual over the cushioning layer, other sensed parameters (e.g., snoring, breathing patterns, etc.), timing (e.g., time of day, time during an individual's sleep cycle, etc.).

Other aspects of the disclosed subject matter, as well as features and advantages of various aspects of the disclosed subject matter, should become apparent to those of ordinary skill in the art through the preceding disclosure, the images that follow, and the appended claims.

DETAILED DESCRIPTION

Figure 1:
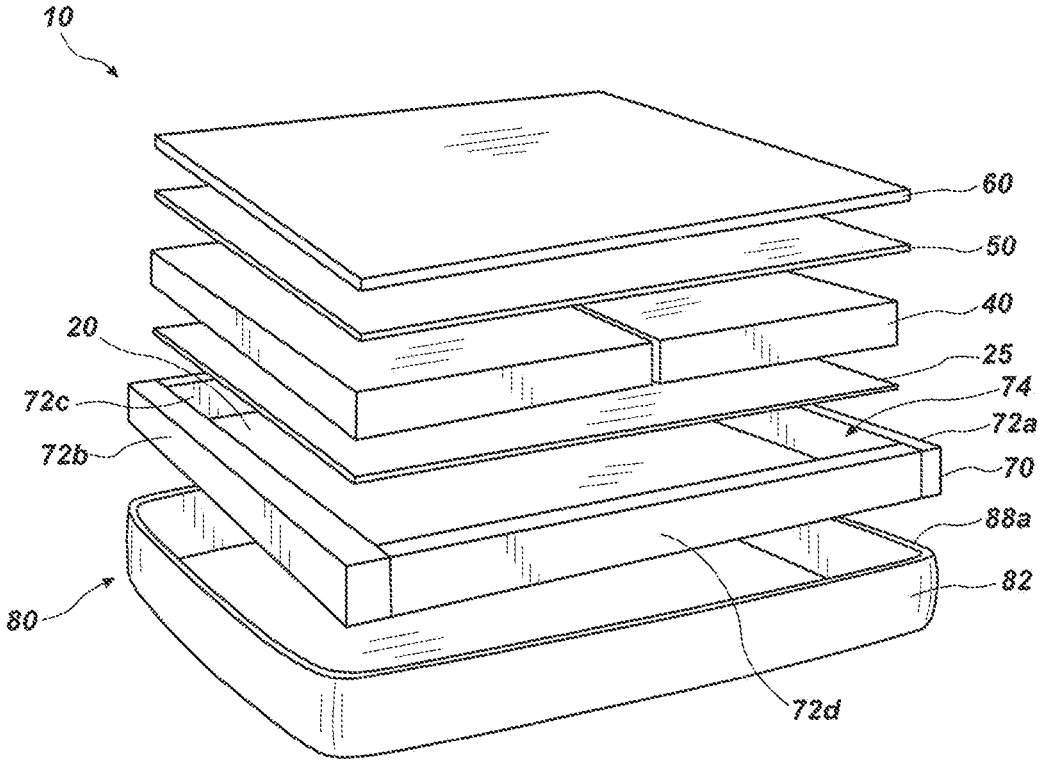
FIG. 1 is an exploded view of a portion of a composite mattress that includes one or more air chambers, showing the pressurizable layer and various other internal elements of the composite mattress, as well as a base portion of a cover of the composite mattress.
Figure 2:
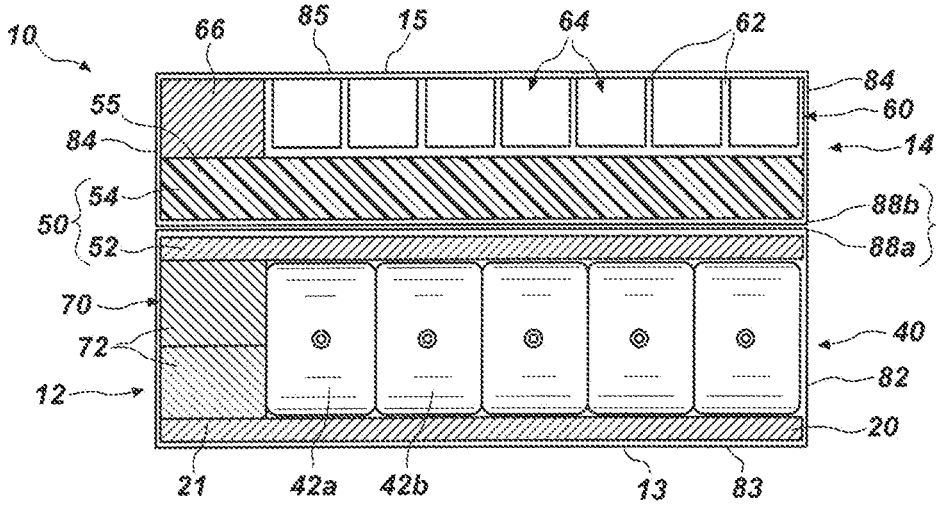
FIG. 2 is a cross-sectional representation of a portion of an embodiment of the composite mattress shown in FIG. 1.

Referring to FIGS. 1 and 2, a portion of a composite mattress 10 according to this disclosure is depicted. The composite mattress 10 may include a base layer 20, a pressurizable layer 40, an intermediate layer 50, and a top layer 60 in superimposed relation. Optionally, the composite mattress 10 may include a base cushion 25. A foundation 70 may extend around the optional base cushion 25, the pressurizable layer 40, the intermediate layer 50, and the top layer 60. A cover 80 may enclose or envelop all of the other components of the composite mattress 10.

The base layer 20 of the composite mattress 10 may provide a barrier between the next adjacent element (e.g., the base cushion 25 in FIG. 1, the pressurizable layer 40 in FIG. 2, a coiled spring layer 430 in FIG. 8, etc.) and an exterior, base surface 13 (FIG. 2) of the composite mattress 10. The base layer 20 may also support the elements superimposed over it.

In some embodiments, the base layer 20 may comprise a relatively stiff but somewhat flexible element. As an example, such a base layer 20 may be formed from a layer of a "structured foam," which may comprise a compressible foam material with an indentation load deflection (ILD) rating of about 40 or greater (e.g., 40, 45, 50, 55, 60, etc.). An ILD rating is the amount of pressure, converted to weight in pounds, it takes to indent a circular area of 50 square inches (i.e., lbs/50 $in^2$) over a four inch thick piece of the structured foam by 25% (i.e., one inch). In a specific embodiment, the base layer 20 may comprise a layer of polyurethane foam with a nominal density of about 2.0 $lb/ft^3$ and an ILD rating of 50-55.

In other embodiments, the base layer 20 may comprise a cushioning element. For example, the base layer 20 may have an ILD rating of 20 or less. Such a base layer 20 may comprise a layer of a readily compressible foam material (e.g., a polyurethane foam, a foam rubber, etc.). Alternatively, such a base layer 20 may be a cushioning element that comprises a plurality of resiliently compressible walls defining an array of resiliently buckling columns and a void within each column, such as the cushioning elements disclosed by U.S. Pat. Nos. 7,060,213, 7,076,822, and 8,919,750, the entire disclosures of which are hereby incorporated herein. Such a cushioning element may be formed from any of a variety of compressible, resilient materials, including cushioning foams and elastomeric materials, such as the extended A-B-A triblock copolymers disclosed by U.S. Pat. Nos. 6,413,458, 6,797,765 and 7,964,664, the entire disclosures of which are hereby incorporated herein.

An optional base cushion 25 may be positioned over the base layer 20, as illustrated by FIG. 1. The optional base cushion 25 may be a cushioning element with a plurality of resiliently compressible walls defining an array of resiliently buckling columns and a void within each column, such as the cushioning elements disclosed by U.S. Pat. Nos. 7,060,213, 7,076,822, and 8,919,750, which may be formed from any suitable material, including but not limited to an extended A-B-A triblock copolymer, such as those disclosed by U.S. Pat. Nos. 6,413,458, 6,797,765 and 7,964,664.

The pressurizable layer 40 may also be positioned over the base layer 20. The pressurizable layer 40 may comprise one or more air chambers 42 (air chambers 42*a*, 42*b*, etc., are shown in FIG. 2). The air chamber(s) 42 of the pressurizable layer 40 may be selectively inflated and/or deflated in any suitable manner known in the art. Each air chamber 42 may comprise a material that will enable the air chamber 42 to expand, or inflate, when the air pressure therein is increased; thus, each air chamber 42 may include one or more flexible walls. The material from which each air chamber 42 is formed may be impermeable to air (i.e., it may receive and substantially retain air for prolonged periods of time (e.g., months, years, etc.).

In some embodiments where the pressurizable layer 40 includes a plurality of air chambers 42, the air chambers 42 may be elongated and arranged parallel to one another; elongated air chambers 42 may be oriented across at least a portion of a width of the composite mattress 10. For example, elongated air chambers 42 may be extend across non-peripheral areas of the composite mattress 10. As another example, elongated air chambers 42 may extend across non-peripheral and non-midline areas of a side, or half, of the composite mattress 10. In other embodiments where the pressurizable layer 40 includes a plurality of air chambers 42, the air chambers 42 may have regular polygonal shapes (e.g., square, hexagonal, etc.) and be arranged in an array.

In some embodiments, the air chamber(s) 42 of the pressurizable layer 40 may be removed and replaced. Removal and replacement of the air chamber(s) 42 may be useful in situations where an air chamber 42 fails, an upgraded air chamber 42 is desired, and the like.

A pressurization system (not shown), including one or more air pumps, conduits, electronics, and programming, as known in the art, may be associated with the pressurizable layer 40.

The intermediate layer 50 of the composite mattress 10 may be positioned over the pressurizable layer 40. The intermediate layer 50 may comprise a cushioning element that transmits variations in pressure from the pressurizable layer 40 to the layers (e.g., the top layer 60, etc.) of the composite mattress 10 located over the intermediate layer 50. By way of example, the intermediate layer 50 may include one or more layers of a compressible, resilient foam (e.g., a foam rubber, a memory foam (e.g., a viscoelastic polyurethane foam, etc.), etc.). As another example, the intermediate layer 50 may comprise a cushioning element with a plurality of resiliently compressible walls defining an array of resiliently buckling columns and a void within each column, such as the cushioning elements disclosed by U.S. Pat. Nos. 7,060,213, 7,076,822, and 8,919,750, which may be formed from any suitable material, including, but not limited to, an extended A-B-A triblock copolymer, such as those disclosed by U.S. Pat. Nos. 6,413,458, 6,797,765 and 7,964,664.

The top layer 60 of the composite mattress 10 may be positioned over the intermediate layer. The top layer 60 provides desired cushioning properties and a desired firmness (e.g., ILD rating, etc.) for an individual as he or she lies on the composite mattress 10. The top layer 60 may have an ILD rating of about 12 to 16.5 (super-plush), 16.5 to 22.5 (plush), 22.5 to 26.5 (soft), 26.5 to 30.5 (medium), 30.5 to 34.5 (firm), 34.5 to 38.5 (extra-firm), or greater.

As shown in FIG. 2, the top layer 60 may comprise a cushioning element with a plurality of resiliently compressible walls 62 defining an array of resiliently buckling columns and a void 64 within each column. Embodiments of such cushioning elements are disclosed by U.S. Pat. Nos. 7,060,213, 7,076,822, and 8,919,750. The resiliently compressible walls 62 of the top layer 60 may be formed from any suitable material, including, but not limited to, an extended A-B-A triblock copolymer, such as those disclosed by U.S. Pat. Nos. 6,413,458, 6,797,765 and 7,964,664.

In other embodiments, the top layer 60 may comprise a cushioning material that non-resiliently flows under pressure. Such a cushioning element may include a pliable bladder that contains a plurality of cushioning elements (e.g., hollow acrylic microspheres, etc.) within a flowable (e.g., semisolid, liquid, etc.) lubricant (e.g., a silicone, etc.), similar to the cushioning elements disclosed by U.S. Pat. No. 6,197,099 of Pearce, the entire disclosure of which is hereby incorporated herein.

With continued reference to FIGS. 1 and 2, the foundation 70 of the composite mattress 10 may extend around an optional base cushion 25 and the pressurizable layer 40. In some embodiments, the foundation 70 may also extend around the intermediate layer 50 and/or the top layer 60. The foundation 70 may include a plurality of walls 72*a*, 72*b*, 72*c*, 72*d* arranged about the periphery of the base layer 20 at the head (wall 72*a*), foot (wall 72*b*), and sides (walls 72*c* and 72*d*) of the composite mattress 10. For the sake of simplicity, each of the walls 72*a-d* may also be referred to herein as a "wall 72" and two or more of the walls 72*a-d* may be referred to as "walls 72." In some embodiments, such as that depicted by FIG. 1, the walls 72 may surround an outer periphery of the base layer 20. In other embodiments, such as that depicted by FIG. 2, the walls 72 may be positioned on peripheral portions 21 of the base layer 20. Together, the walls 72 and the base layer 20 may define a receptacle 74 for an optional base cushion 25, the pressurizable layer 40, and, optionally, the intermediate layer 50 and/or the top layer 60, as well as other interior elements, or interior components, of the composite mattress 10. As can be seen from FIG. 2, in some embodiments, the walls 72 of the foundation 70 may include two or more layers.

The walls 72 of the foundation 70 may comprise relatively stiff but somewhat flexible elements. As an example, the walls 72 may be formed from a layer of a structured foam. The walls 72 may be formed from the same structured foam as the base layer 20 or from a different (e.g., less rigid, etc.) structured foam. An ILD rating of the foundation 70, or its walls 72, may exceed the ILD rating of the top layer 60. In a specific embodiment, the walls 72 of the foundation 70 may comprise polyurethane foam with a nominal density of about 2.0 lb/ft$^3$ and an ILD rating of 35-55. In other embodiments, the walls 72 of the foundation 70 may comprise a so-called "spacer fabric," such as that disclosed by U.S. Pat. No. 10,881,217, the entire disclosure of which is hereby incorporated herein.

The cover 80 of the composite mattress 10 may be placed over and contain all of the interior elements, or interior components, of the composite mattress 10. Without limitation, the cover 80 may be placed over and contain the base layer 20, any base cushion 25, the pressurizable layer 40, the intermediate layer 50, the top layer 60, and the foundation 70. In some embodiments, the cover 80 may include a base portion 82, a top portion 84, and coupling elements 88*a* and 88*b* of a coupler 88 that secure the base portion 82 to the top portion 84.

The base portion 82 of the cover 80 may carry or even contain, or enclose or envelop, elements at the base 12 of the composite mattress, such as the base layer 20, the pressurizable layer 40, at least a base portion of the foundation 70, and, optionally, a portion of the intermediate layer 50, as depicted by FIG. 2. A first coupling element 88*a* of the coupler 88 may be positioned adjacent to or on an upper periphery of the base portion 82 of the cover 80. The top portion 84 of the cover 80 may carry or even contain, or enclose or envelop, elements at the top 14 of the composite mattress 10, such as a portion of the intermediate layer 50 and the top layer 60, as shown in FIG. 2. A second coupling element 88*b* of the coupler 88 may be positioned adjacent to or on a lower periphery of the top portion 84 of the cover 80.

In embodiments where the base portion 82 and top portion 84 of the cover 80 contain their respective elements of the composite mattress 10, the resulting base 12 and top 14 of the composite mattress 10 may be readily assembled with and disassembled from one another. In some embodiments, a single base portion 82 and, thus, a single base 12 of a composite mattress 10 may have configurations that enable them to receive two or more top portions 84 and, thus, two or more portions of a top 14 of the composite mattress 10. In other embodiments, two or more base portions 82 and, thus, portions of a base 12 of a composite mattress 10 may collectively receive a single top portion 84 of the cover 80 and, thus, a single top 14 of the composite mattress 10.

The separable base portion 82 and top portion 84 may impart a composite mattress 10 with modularity. More specifically, a base portion 82 of the cover 80 may be used with a plurality of different bases 12 and/or the top portion 84 of the cover 80 may be used with a plurality of different tops 14 to enable an individual or a couple to select and bases 12 and/or tops 14 with particular characteristics.

The cover 80 may comprise any suitable material. A top panel 85 of the top portion 84 of the cover 80 may comprise a fabric that carries a resiliently compressible web on a surface (e.g., an underside, etc.) thereof. The resiliently compressible web may define a structured array, or a grid, of regular polygonal openings (e.g., a hexagonal array, or a hexagonal grid, of openings, etc.). The resiliently compressible web may be formed from any suitable material, such as an elastomeric material (e.g., an extended A-B-A triblock copolymer, such as those disclosed by U.S. Pat. Nos. 6,413,458, 6,797,765 and 7,964,664, etc.). In some embodiments, the resiliently compressible web of such a top panel 85 may be located between a pair of superimposed layers of fabric.

The fabric of the top panel 85, as well as peripheral portions of the top portion 84 of the cover 80, peripheral portions of the base portion 82 of the cover 80, and, optionally, a base panel 83 of the base portion 82 may comprise a stretchable material (e.g., a stretchable fabric, etc.). The stretchability of the material of the top panel 85 and, optionally, of peripheral portions of the top portion 84 and base portion 82 of the cover 80 may enable an individual to experience the full cushioning effect of the cushioning elements of the composite mattress 10. Stated another way, the stretchability of the material of the top panel 85 and, optionally, of peripheral portions of the top portion 84 and base portion 82 of the cover 80 may not limit the extent to which the composite mattress 10 (e.g., the top layer 60, etc., thereof) may cushion an individual sitting or lying on the composite mattress 10 or an object that has been placed on the composite mattress 10. Additionally, the stretchability of the material of the top panel 85 and, optionally, of peripheral portions of the top portion 84 and base portion 82 of the cover 80 may enable complete or substantially complete (e.g., due to a thickness of the top panel 85, etc.) transmission of the effects of pressurization of the pressurizable layer 40 on an upper surface of the top layer 60 through the top panel 85. U.S. Patent Application Publication US 2017/0251825 A1, the entire disclosure of which is hereby incorporated herein, provides examples of stretchable materials that may be used to form the cover 80 or parts thereof.

In some embodiments where a base panel 83 of the base portion 82 of the cover 80 does not comprise the same material as a remainder of the cover 80, a non-stretchable material may form the base panel 83. A fabric that is non-stretchable may stretch due to a weave of the fabric, but lack stretchable fibers. Such a fabric may comprise a so-called "non-skid" fabric.

The coupler 88 and its coupling elements 88*a* and 88*b* may comprise any apparatus(es) that may enable the base 12 and top 14 of the composite mattress 10 to be secured to each other. Without limitation, the coupler 88 may comprise one or more zippers, with the first coupling element 88*a* comprising a first side, or ribbon, of the zipper and the second coupling element 88*b* comprising a second side, or ribbon, of the zipper. In addition, such a coupling element 88*b* may include a zipper pull (not shown), the use of which (i.e., movement along the length of the zipper) causes the coupling elements 88*a* and 88*b* to selectively engage and/or disengage each other. Other embodiments of couplers 88 include other mutually engaging elements, such as buttons and buttonholes, snap-fit features, touch fasteners (e.g., so-called "velcro" fasteners, etc.), and the like.

FIG. 2 depicts an embodiment of composite mattress 10 in which a base 12 of a composite mattress 10 includes a bottom portion 82 of a cover 80 that encloses or envelops a base layer 20, a foundation 70, a pressurizable layer 40, and an intermediate base layer 52. The foundation 70 sits atop peripheral portions 21 of the base layer 20 and laterally surrounds the pressurizable layer 40. The pressurizable layer 40 includes a plurality of air chambers 42*a*, 42*b*, etc. The intermediate base layer 52 sits atop the foundation 70 and the pressurizable layer 40.

The top 14 of the composite mattress 10 shown in FIG. 2 includes a top portion 84 of the cover 80 that encloses or envelops an intermediate top layer 54, a top layer 60, and an upper foundation 66. The upper foundation 66 sits atop peripheral portions 55 of the intermediate top layer 54 and laterally surrounds the top layer 60. The upper foundation 66 may comprise a relatively stiff but somewhat flexible element. As an example, the upper foundation 66 may be formed from a foam or a structured foam. An ILD rating of the upper foundation 66 may exceed the ILD rating of the top layer 60. In a specific embodiment, the upper foundation 66 may comprise polyurethane foam with a nominal density of about 2.0 lb/ft$^3$ and an ILD rating of 25-55. In other embodiments, the upper foundation 66 may comprise a spacer fabric of the type disclosed by U.S. Pat. No. 10,881,217.

When the top 14 of the composite mattress 10 is positioned over the base 12 of the composite mattress 10, the intermediate base layer 52 and the intermediate top layer 54 may be positioned in proximity to each other. These layers, as well as portions of the base portion 82 and top portion 84 of the cover 80 between them, may comprise an intermediate layer 50 of the composite mattress 10. As depicted by FIG. 2, the intermediate base layer 52 and the intermediate top layer 54 may comprise a compressible, resilient foam (e.g., a foam rubber, a memory foam, etc.).

Figure 3:
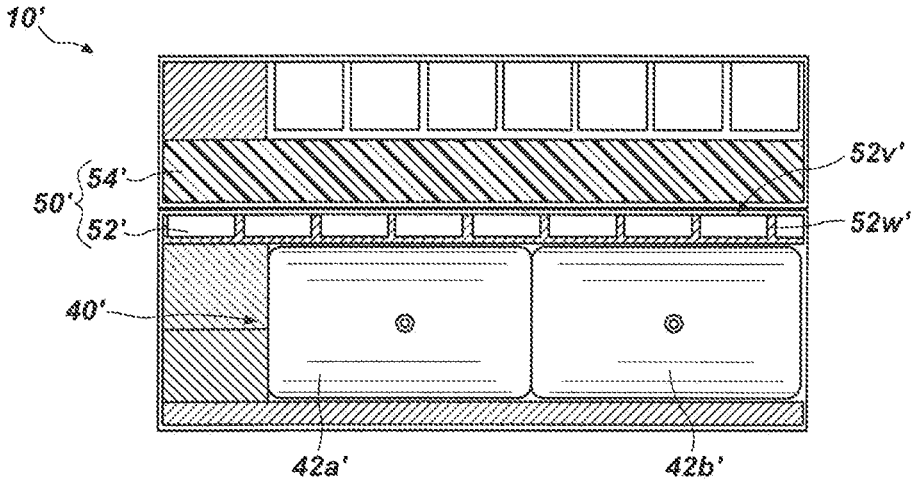
FIG. 3 is a cross-sectional representation of a portion of a variation of the embodiment of the composite mattress shown in FIG. 2.

Turning now to FIG. 3, a variation of composite mattress 10' is depicted in which the intermediate layer 50' includes an intermediate top layer 54' that comprises a compressible, resilient foam and an intermediate base layer 52' that includes a plurality of resiliently compressible walls 52*w'* defining an array of resiliently buckling columns and a void 52*v'* within each column, such as the cushioning elements disclosed by U.S. Pat. Nos. 7,060,213, 7,076,822, and 8,919,750. Such an intermediate base layer 52' may be formed from any suitable material, including, but not limited to, an extended A-B-A triblock copolymer, such as those disclosed by U.S. Pat. Nos. 6,413,458, 6,797,765 and 7,964,664.

The pressurizable layer 40' of the composite mattress 10' shown in FIG. 3 also includes fewer and larger air chambers 42*a'*, 42*b'*, etc., than the air chambers 42*a*, 42*b*, etc., of the pressurizable layer 40 of the composite mattress 10 shown in FIG. 2.

Figure 4:
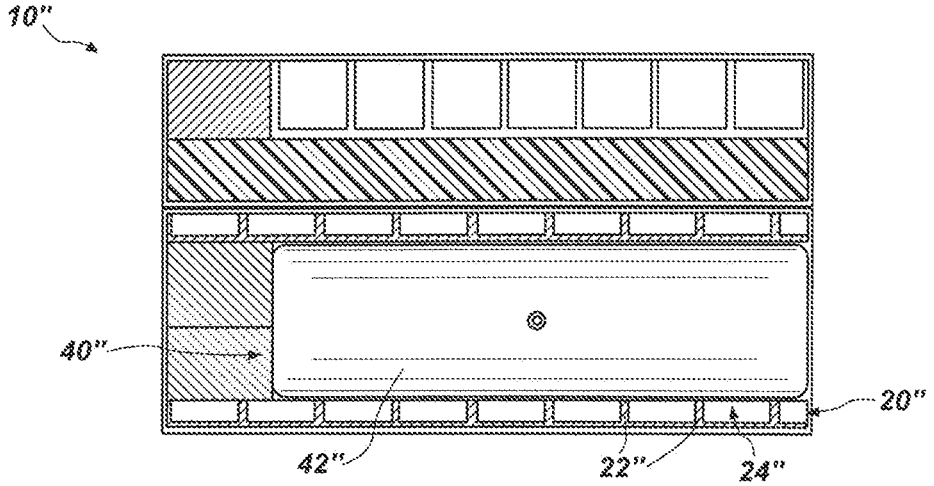
FIG. 4 is a cross-sectional representation of a portion of another variation of the embodiment of the composite mattress shown in FIG. 2.

FIG. 4 illustrates another variation of composite mattress 10" that includes even fewer (possibly one) and larger air chambers 42" than the air chambers 42*a'*, 42*b'*, etc. of the pressurizable layer 40' of the composite mattress 10' shown in FIG. 3. FIG. 4 also illustrates a composite mattress 10" that includes a base layer 20" that comprises a plurality of resiliently compressible walls 22" defining an array of resiliently buckling columns and a void 24" within each column, such as the cushioning elements disclosed by U.S. Pat. Nos. 7,060,213, 7,076,822, and 8,919,750. Such a base layer 20" may be formed from any suitable material, including, but not limited to, an extended A-B-A triblock copolymer, such as those disclosed by U.S. Pat. Nos. 6,413,458, 6,797,765 and 7,964,664.

Figure 5:
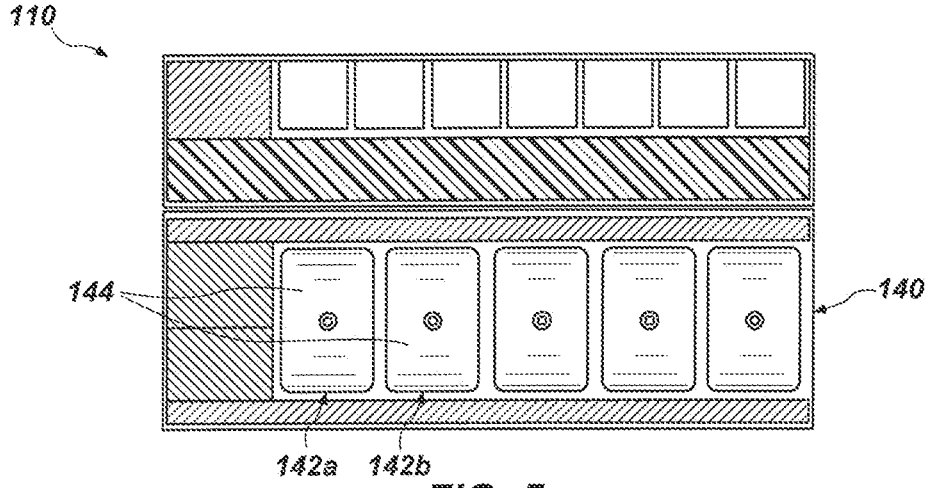
FIG. 5 is a cross-sectional representation of a portion of another embodiment of the composite mattress shown in FIG. 1, which includes a pressurizable layer with air chambers with a filler therein.

With reference to FIG. 5, some embodiments of composite mattresses 110 according to this disclosure may include pressurizable layers 140 with one or more air chambers 142*a*, 142*b*, etc. Each air chamber 142*a*, 142*b*, etc., may also be referred to herein as an "air chamber 142" for the sake of simplicity. Each air chamber 142 includes a pressurizable bladder with a filler 144 therein. The filler 144 may enable the pressurizable bladder of each air chamber 142 to be pressurized and depressurized while imparting each air chamber 142 with a minimum relaxed volume, which is a minimum volume the air chamber 142 will occupy when it is internally pressurized to an ambient air pressure (e.g., 760 mm Hg at sea level, etc.) and no external pressure (e.g., compressive force, etc.) is applied thereto. In some embodiments, the filler 144 may comprise a compressible, resilient foam (e.g., an open-celled foam into and/or through which air may flow, a closed-cell foam around which air may flow, etc.). The use of a compressible, resilient material may enable each air chamber 142 to readily compress when a force is applied thereto and readily expand when the force is released therefrom. In other embodiments, the filler 144 may comprise a stiffer or firmer material, such as a structured foam (e.g., an open-celled structured foam, a closed-cell structured foam, etc.). The use of a stiffer material as the filler 144 may enable each air chamber 142 to resist compression when a force is applied thereto and, depending on the type of material employed, readily expand when the force is released (e.g., with an elastic material) or gradually expand when the force is released (e.g., with a viscoelastic material).

Figure 6:
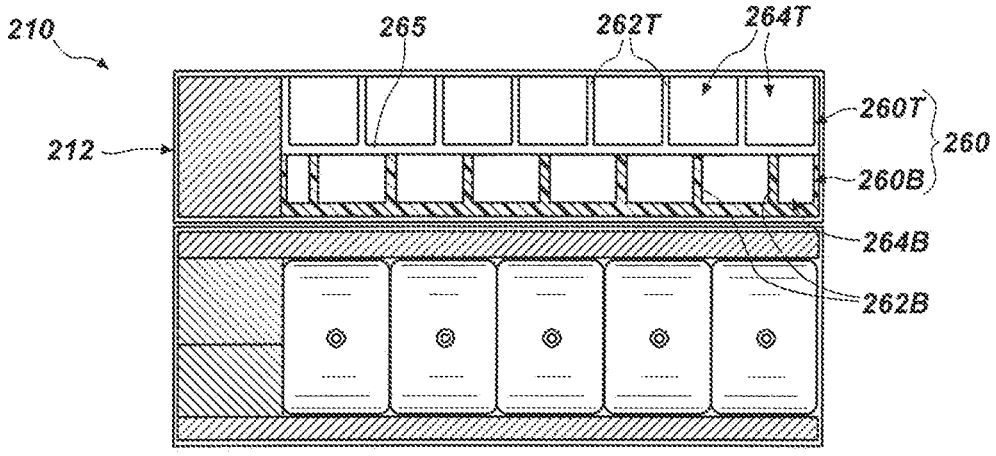
FIG. 6 is a cross-sectional representation of a portion of yet another embodiment of the composite mattress shown in FIG. 1, in which a top layer includes a plurality of sublayers.

The embodiment of composite mattress 210 shown in FIG. 6 includes a top layer 260 with a plurality of sublayers 260B and 260T. The sublayers 260B and 260T may have the same thickness as each other or different thicknesses from one another. As depicted the base sublayer 260B may be thinner than the top sublayer 260T. The base sublayer 260B may include walls 262B that define an array of resiliently buckling columns and a void 264B extending along the height of each column. The top sublayer 260T may include walls 262T that define an array of resiliently buckling columns and a void 264T extending along the height of each column. At least some of the walls 262T and voids 264T of the top sublayer 260T may be respectively offset from the walls 262B and voids 264B of the bottom sublayer 260B. As depicted, the top layer 260 may include an interface wall 265 defining a solid boundary between the base sublayer 260B and the top sublayer 260T, as well as a top end of each void 264B of the base sublayer 260B and a base end of each void 264T of the top sublayer 260T. Alternatively, an interface between the base sublayer 260B and the top sublayer 260T of the top layer 260 may lack a wall; thus, overlapping or partially overlapping voids 264B and 264T may communicate with each other.

The top 212 of the composite mattress 210 illustrated by FIG. 6 may lack an intermediate top layer. In some such embodiments, the base sublayer 260B may replace the intermediate top layer of other embodiments of composite mattresses according to this disclosure (e.g., the intermediate top layer 54 shown in FIG. 1).

Figure 7:
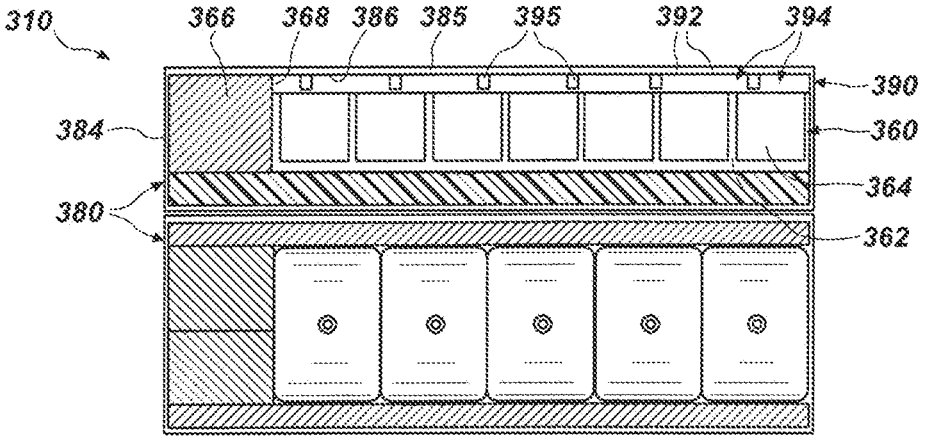
FIG. 7 is a cross-sectional representation of a variation of the embodiment of composite mattress shown in FIG. 6.

Turning now to FIG. 7, an embodiment of composite mattress 310 in which an upper surface of the top layer 360 is recessed relative to an upper surface of the upper foundation 366 that laterally surrounds at least a portion of the top layer 360, defining a receptacle 368 over the top layer 360. The receptacle 368 has a depth that is the same as or substantially the same as a thickness of a web 390 received by the receptacle 368 and, thus, positioned over the top layer 360.

In some embodiments, the web 390 may be resiliently compressible. The web 390 may be formed from any suitable material, such as an elastomeric material (e.g., an extended A-B-A triblock copolymer, such as those disclosed by U.S. Pat. Nos. 6,413,458, 6,797,765 and 7,964,664, etc.).

The web 390 may comprise a structured array 392, or a grid, that defines regular polygonal openings 394 (e.g., a hexagonal array, or a hexagonal grid, of openings, etc.). The structured array 392 may differ from a structured array defined by walls 362 of the top layer 360 in shape, wall width, and/or dimensions relative to corresponding cross-sectional dimensions of the voids 364 of the top layer 360. The structured array 392 of the web 390 may be at least partially offset from the structured array of the top layer 360.

Alternatively, or in addition, the web 390 may carry one or more sensors 395. Various non-limiting examples of sensors 395 that may be carried by the web 390 include pressure sensors, temperature sensors, sound sensors, heart rate sensors, and the like. The sensors 395 may enable monitoring of a variety of parameters associated with the quantity and/or quality of sleep achieved by one or more individuals as they use the composite mattress 310, including without limitation the extent to and/or frequency with which they move, the sounds they make while sleeping (e.g., breathing, snoring, etc.), their respiratory rate, their heart rate, and the like.

The web 390 may be carried by a bottom surface 386 of a top panel 385 of a top portion 384 of a cover 380 of the composite mattress 310. Alternatively, the web 390 may be located between a pair of superimposed layers of fabric that define the top panel 385 of the top portion 384 of the cover 380. As another alternative, the web 390 may be separate from, but held in place by, the top panel 385.

Figure 8:
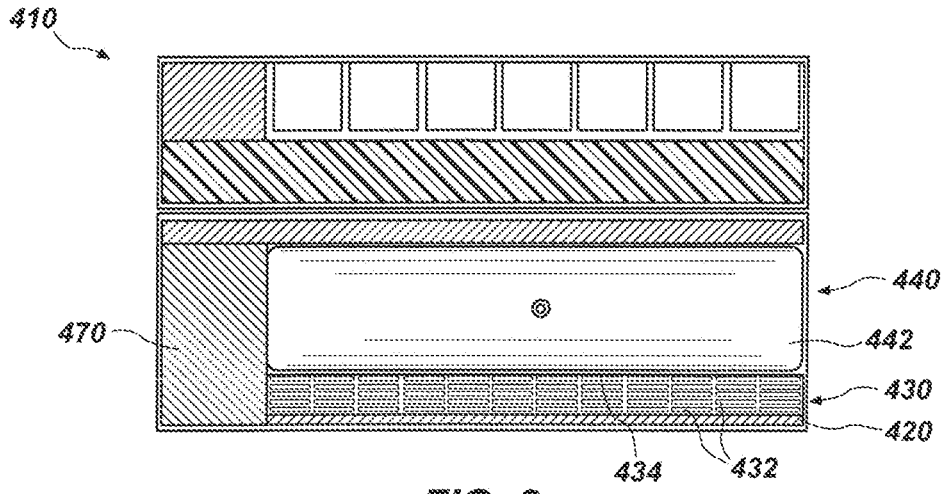
FIG. 8 is a cross-sectional representation of a portion of still another embodiment of the composite mattress shown in FIG. 1, which includes a coiled spring layer, with the coiled spring layer being located beneath the pressurizable layer.

In FIG. 8, an embodiment of composite mattress 410 that includes a coiled spring layer 430 is depicted. The coiled spring layer 430 may be positioned between the base layer 420 and the pressurizable layer 440 of the composite mattress 410 and, along with the base layer 420 and the pressurizable layer 440, at least partially laterally surrounded by the foundation 470.

The coiled spring layer 430 may include an array of coil springs 432. Each coil spring 432 may comprise a collapsible, resilient coil (e.g., a metal (e.g., steel, etc.) coil, etc.). The coil springs 432 comprise so-called "pocketed" coils, in which each coil is contained within a bag, or a sock. In some embodiments, the coil springs 432 may comprise pocketed coils of the types described by U.S. Patent Application Publication US 2019/0150632 A1, the entire disclosure of which is hereby incorporated herein.

Figure 9:
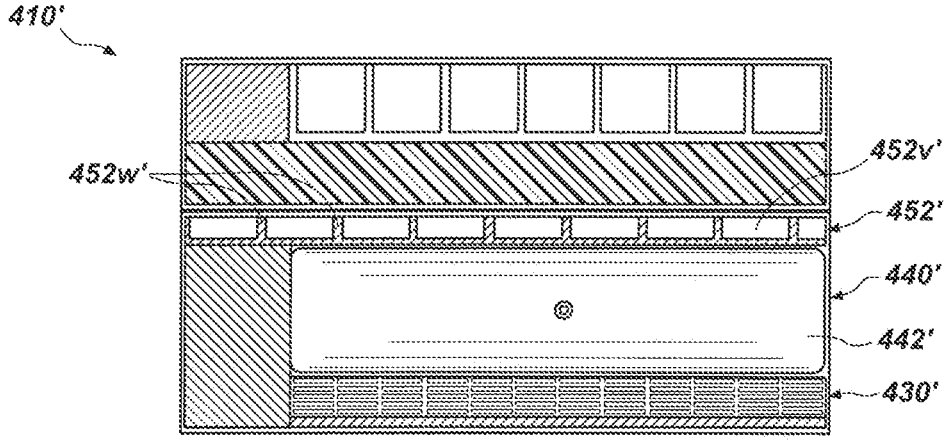
FIG. 9 is a cross-sectional representation of a variation of the embodiment of composite mattress shown in FIG. 8.

FIG. 9 shows a variation of composite mattress 410' that includes a coiled spring layer 430' beneath its pressurizable layer 440'. The intermediate base layer 452' of such an embodiment may comprise a plurality of resiliently compressible walls 452*w'* defining an array of resiliently buckling columns and a void 452*v'* within each column, such as the cushioning elements disclosed by U.S. Pat. Nos. 7,060,213, 7,076,822, and 8,919,750. Such an intermediate base layer 452' may be formed from any suitable material, including, but not limited to, an extended A-B-A triblock copolymer, such as those disclosed by U.S. Pat. Nos. 6,413,458, 6,797,765 and 7,964,664.

Figure 10:
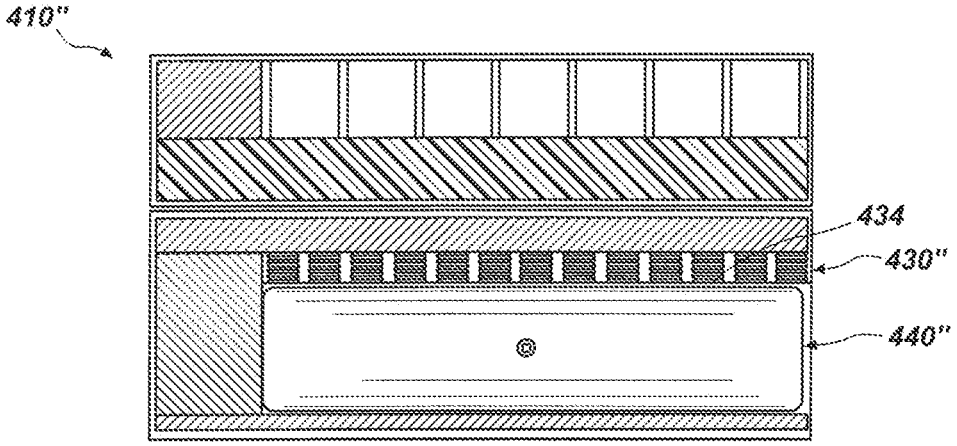
FIG. 10 is a cross-sectional representation of another variation of the embodiment of composite mattress shown in FIG. 8, in which the coiled spring layer is located over the pressurizable layer.
Figure 11:
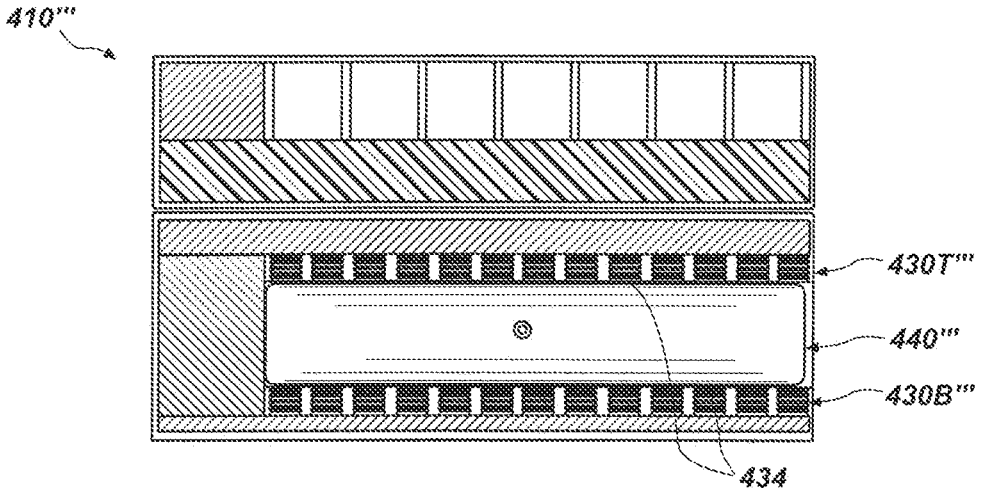
FIG. 11 is a cross-sectional representation of yet another variation of the embodiment of composite mattress shown in FIG. 8, in which coiled spring layers are located over and beneath the pressurizable layer.

Other arrangements of coiled spring layers are also within the scope of this disclosure. The composite mattress 410" of FIG. 10 includes a coiled spring layer 430" over its pressurizable layer 440", while the composite mattress 410''' of FIG. 11 includes a coiled spring layer 430B''' beneath its pressurizable layer 440''' and another coiled spring layer 430T''' over its pressurizable layer 440'''.

An intervening layer 434 formed from a flexible material (e.g., a polymeric film, a fabric, etc.) may serve as a barrier (e.g., a protective layer, etc.) between the pressurizable layer 440, 440", 440''' from each adjacent coiled spring layer 430, 430", 430B''', 430T'''.

Figure 12:
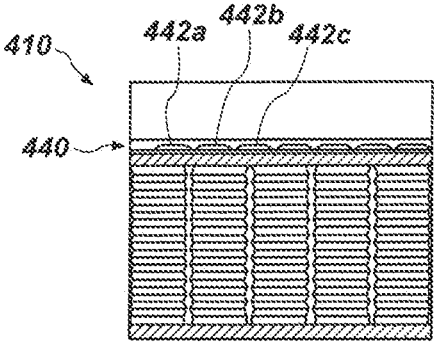
FIG. 12 schematically depicts the air bladder(s) of a composite mattress according to this disclosure in an uninflated state.
Figure 13:
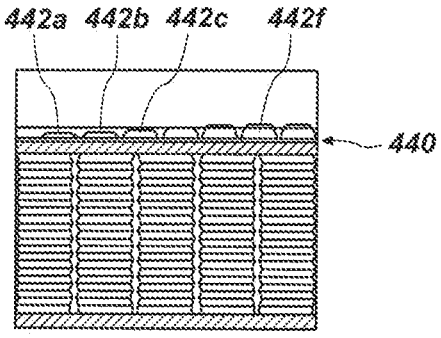
FIG. 13 schematically depicts the air bladders of a composite mattress according to the disclosure in an embodiment of an inflated state, in which various air bladders are inflated to different extents.

With reference now turned to FIGS. 12 and 13, use of the pressurizable layer 440 of a composite mattress 410 according to this disclosure is depicted. As illustrated, the pressurizable layer 440 may include a plurality of air chambers 442*a*, 442*b*, etc, each of which may also be referred to as an "air chamber 442" for the sake of simplicity. A pressure within each air chamber 442 of the pressurizable layer 440 may be individually adjustable; i.e., each air chamber 442 may be individually inflated and/or deflated.

In FIG. 12, all of the air chambers 442 are inflated to a base state (e.g., they are deflated, inflated to a minimal pressure, inflated to a predetermined base pressure, etc.).

This arrangement may be referred to as a "base state" of the composite mattress 410. With all of the air chambers 442 inflated to the base state, they may have little or no effect on the contour of the composite mattress 410 or the manner in which it supports an individual lying or sitting thereon, other than that its top surface is substantially flat.

When an individual wants to tailor a contour of the composite mattress 410 and/or adjust a manner in which he or she or another individual may be supported by the composite mattress 410, he or she may alter a state of the composite mattress 410 from its base state to a "tailored state" by selectively changing the pressure within one or more of the air chambers 442. FIG. 13 illustrates an embodiment of such tailoring, in which one or more air chambers 442 may be inflated to a different pressure than its base state. In the specific embodiment of tailored state depicted by FIG. 13, air chamber 442*a* is inflated to its base state, while air chambers 442*b-g* may be inflated (or deflated) to any of a variety of other states.

As an alternative or in addition to an individual tailoring how the pressurizable layer 440 is pressurized, pressurization of the pressurizable layer 440 may be adjusted in response to one or more sensed conditions on the composite mattress 410, such as one or more locations on a top surface of the composite mattress 410 to which pressure is applied, one or more conditions of an individual lying on the composite mattress 410 (e.g., extent and/or frequency of movement, sound (e.g., breathing, snoring, etc.), respiratory rate, heart rate, etc.), or the like. In this regard, a composite mattress 410 according to this disclosure may also be equipped with one or more sensors that may be used to evaluate one or more characteristics of each individual resting or sleeping on the composite mattress 410. Without limitation, a composite mattress 410 may include pressure sensors, temperature sensors, sound sensors, heart rate sensors, and the like. The data obtained with sensors of the composite mattress 410 may be useful for evaluating the length and quality of sleep achieved by each individual lying on the composite mattress 410 and for automatically adjusting the composite mattress 410 (e.g., the pressurizable layer 440 thereof, etc.) in a manner that will improve the quantity and/or quality of sleep achieved by each individual who uses the composite mattress 410.

Although the preceding disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A mattress, comprising:
a coiled spring layer;
a pressurizable layer; and
a top layer over the coiled spring layer and the pressurizable layer and comprising a plurality of compressible walls defining an array of buckling columns.

2. The mattress of claim 1, further comprising:
a foundation including at least one peripheral foundation member defining a foundation receptacle.

3. The mattress of claim 2, wherein the coiled spring layer is located within the foundation receptacle.

4. The mattress of claim 3, wherein the pressurizable layer is located within the foundation receptacle.

5. The mattress of claim 1, further comprising:
an intermediate layer on the pressurizable layer, the top layer being located on the intermediate layer.

6. The mattress of claim 1, further comprising:
a bottom cover including a cover base with a peripheral edge;
a cover periphery extending from the peripheral edge of the bottom cover, with a cover receptacle being defined by the cover periphery and the cover base, the cover receptacle receiving the coiled spring layer; and
a top cover over the top layer.

7. The mattress of claim 6, wherein at least a portion of the cover periphery is continuous with the cover base and further comprising:
a coupler at or adjacent to a top edge of the cover periphery, the coupler coupling the top cover to the cover periphery.

8. The mattress of claim 1, wherein the pressurizable layer is located over the coiled spring layer.

9. The mattress of claim 1, wherein the pressurizable layer comprises a plurality of air chambers.

10. The mattress of claim 9, wherein the plurality of air chambers are independently pressurizable.

11. The mattress of claim 9, further comprising:
a pressure sensor associated with the top layer.

12. The mattress of claim 9, further comprising:
a web of elastomeric material defining a structured grid defining a plurality of polygonal openings superimposed with the top layer.

13. A cushion, comprising:
a pressurizable layer; and
a cushioning layer over the pressurizable layer and comprising a plurality of compressible walls defining an array of buckling columns to support at least part of an individual's body, a contour of the cushioning layer definable by pressurization of the pressurizable layer.

14. The cushion of claim 13, wherein the pressurizable layer comprises a plurality of air chambers.

15. The cushion of claim 14, wherein the plurality of air chambers comprises a plurality of independently pressurizable air chambers.

16. The mattress of claim 13, further comprising:
a pressure sensor associated with the cushioning layer.

17. A cushioning method, comprising:
positioning at least part of an individual's body on a cushioning layer comprising a plurality of compressible walls defining an array of buckling columns to support at least the part of the individual's body; and
pressurizing at least one air chamber to define a contour of the cushioning layer.

18. The cushioning method of claim 17, wherein pressurizing at least one air chamber comprises individually pressurizing at least one air chamber of a plurality of air chambers.

19. The cushioning method of claim 17, further comprising:
adjusting pressure within the at least one air chamber after positioning at least part of the individual's body on the cushioning layer.

20. The cushioning method of claim 19, wherein adjusting pressure comprises adjusting pressure in accordance with a program.

* * * * *